United States Patent [19]

Amphlett

[11] 4,071,393

[45] Jan. 31, 1978

[54] APPARATUS FOR USE IN THE MANUFACTURE OF A WIRING HARNESS

[75] Inventor: Robert Amphlett, Stoke on Trent, England

[73] Assignee: Lucas Industries Limited, England

[21] Appl. No.: 685,934

[22] Filed: May 12, 1976

[30] Foreign Application Priority Data

May 23, 1975 United Kingdom ..... 22536/75

[51] Int. Cl.[2] ..... H01B 13/00

[52] U.S. Cl. ..... 156/353; 425/517; 156/436; 156/497

[58] Field of Search ..... 425/505, 517, 520; 156/353, 436, 497, 521

[56] References Cited

U.S. PATENT DOCUMENTS

| | | | |
|---|---|---|---|
| 2,254,394 | 9/1941 | Ratley et al. | 156/353 |
| 2,407,354 | 9/1946 | Walton et al. | 156/436 X |
| 3,068,135 | 12/1962 | Bower | 156/436 X |
| 3,226,278 | 12/1965 | Scofield, Sr. et al. | 156/497 |
| 3,481,802 | 12/1969 | Morcell | 156/436 X |
| 3,523,844 | 8/1970 | Crimmins et al. | 156/436 X |
| 3,616,066 | 10/1971 | Rainey | 156/436 |
| 3,919,038 | 11/1975 | Davis | 156/353 X |
| 3,936,344 | 2/1976 | Boll et al. | 156/436 X |

*Primary Examiner*—J. Howard Flint, Jr.
*Attorney, Agent, or Firm*—Holman & Stern

[57] ABSTRACT

Apparatus for use in the manufacture of a wiring harness of the kind including a plurality of conductive leads having their thermoplastic sheaths fused to a thermoplastic backing tape includes first and second rollers between which the leads and the thermoplastic tape pass in use. The rollers press the tape against the leads and at least one of the rollers is driven so that the leads and the tape are driven between the rollers as a result of rotation of the rollers. A hot air blower is movable relative to the rollers between an operative position and a rest position. In the operative position the hot air is blown onto the tape and the sheaths of the leads immediately before they pass between the rollers so that when pressure is applied to them by the rollers the heated surfaces fuse together. The rest position of the heater is spaced from the rollers so that hot air issuing from the heater is not directed onto the rollers.

10 Claims, 7 Drawing Figures

APPARATUS FOR USE IN THE MANUFACTURE OF A WIRING HARNESS

Figure 1:
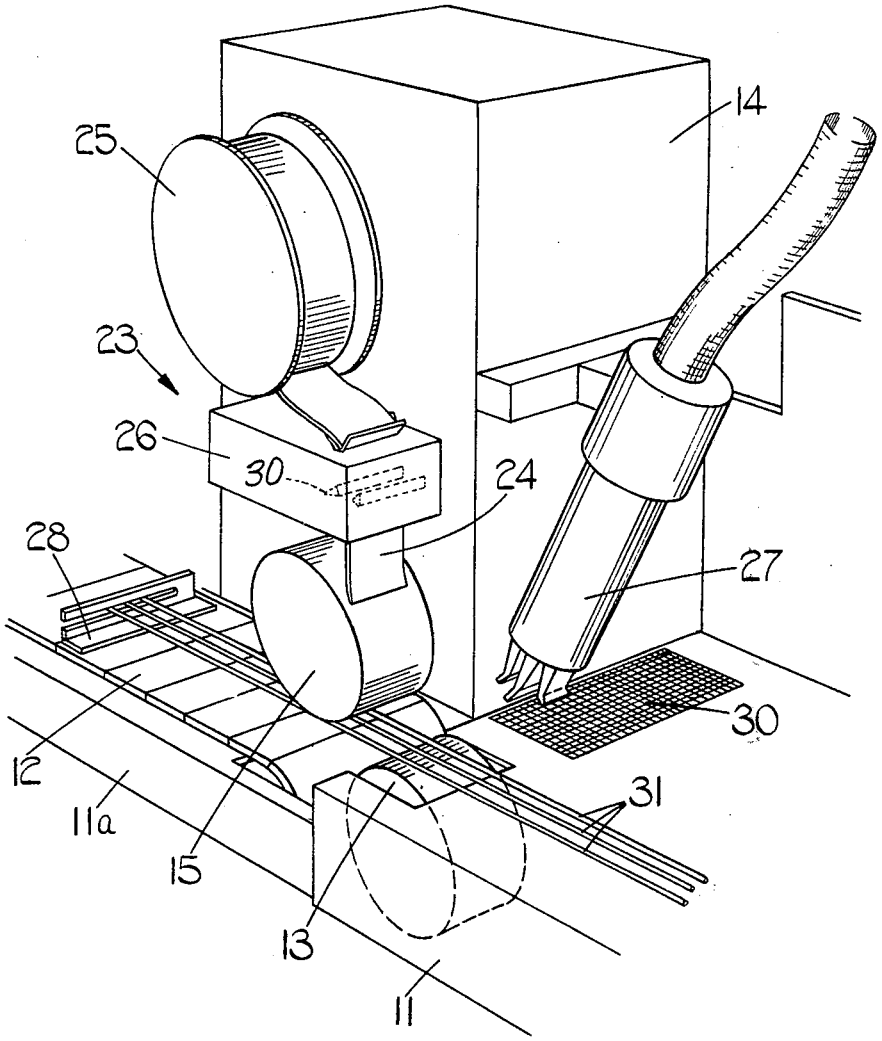

This invention relates to apparatus for use in the manufacture of a wiring harness of the kind including a pluarlity of conductive leads each comprising a thermoplastic sheath containing the conductive core of the lead and a thermoplastic tape to which the sheaths of the leads are fused to hold the leads in the desired relative positions.

In a known apparatus for manufacturing wiring harness of the kind set out above there is provided an elongate platform upon which leads are laid in the relative positions they will occupy in the finished harness. Leads entering or leaving the harness intermediate the ends of the harness are passed through apertures appropriately positioned in the platform. In order to weld the thermoplastic tape to the leads there is provided a movable heater device which can traverse the length of the platform and which carries with it a tape dispenser. This known apparatus works well but is inefficient in terms of size; the platform must be longer than the harness length, operating time; the operator must lay out the leads in the finished orientation, and working time of the heater device; the heater device is producing heat while the leads are laid on the platform. It is an object of the present invention to provide apparatus wherein the above mentioned disadvantages are minimised.

Apparatus according to the present invention includes, first and second rollers between which leads and thermoplastic tape pass in use the rollers pressing the tape against the leads, means driving at least one of the rollers, so that the leads and tape are driven between the rollers by rotation of the rollers, and heater means movable relative to the rollers between an operative position wherein the heater means heats mutually presented surfaces of the tape and sheaths of the leads prior to their passage between the rollers so that the pressure applied by the rollers causes said heated surfaces of the tape and the sheaths to fuse together, and a rest position spaced from the rollers.

Desirably, one or both of said first and second rollers is resilient.

Preferably, the apparatus includes means for moving the heater means from its operative position to its rest position whenever the drive to the rollers is stopped, so that the stationary tape and leads, and/or rollers are not heated.

Desirably, one of the first and second rollers is movable relatively towards and away from the other roller to permit insertion and removal of leads.

Conveniently, the apparatus includes a conveyor mechanism for conveying the harness, as it leaves the rollers away from the rollers, the conveyor being driven at the speed at which the tape and leads passes between the rollers.

Preferably, the apparatus includes a control mechanism which effects control of the means for moving the heater means and the drive of the roller(s) the control mechanism causing the drive to the roller(s) to be stopped when predetermined lengths of harness have been produced, and simultaneously causing the heater means to be moved to its rest position and said control mechanism further upon receipt of a manually controlled re-start signal causing drive to the rollers to be re-established simultaneously with causing return of the heater means to its operative position.

Preferably the drive to the conveyor is directly linked to the drive to the roller(s) so that the roller(s) and conveyor always operate in unison.

Desirably the apparatus includes a tape feed assembly for feeding tape to the rollers, the tape feed assembly including a guillotine for cutting the tape.

Preferably where the apparatus includes the aforementioned control mechanism then control of the guillotine is effected by the control mechanism, the guillotine being operated to sever the tape when a predetermined length of harness has been produced.

Desirably the apparatus includes air extraction means whereby hot air is extracted from the region of the heater, and the rollers while the heater is operative, the extraction of hot air causing an influx of cool air to the said region.

Conveniently, said hot air extraction extends to the region occupied by the heater in its rest position.

Figure 3:
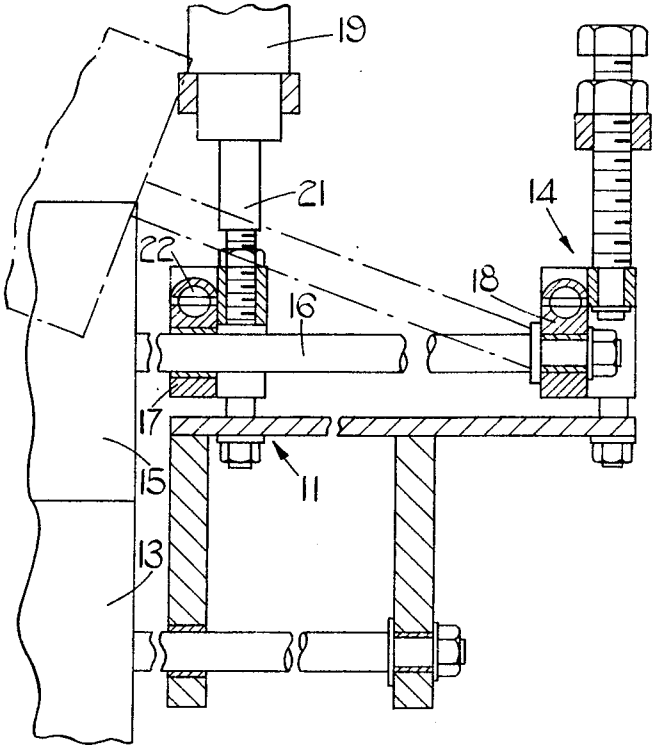
Figure 2:
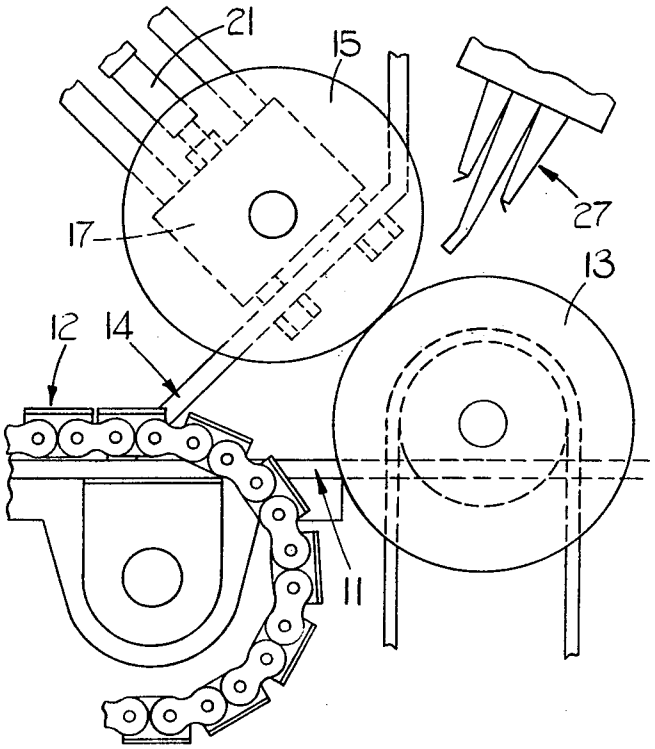
Figure 4:
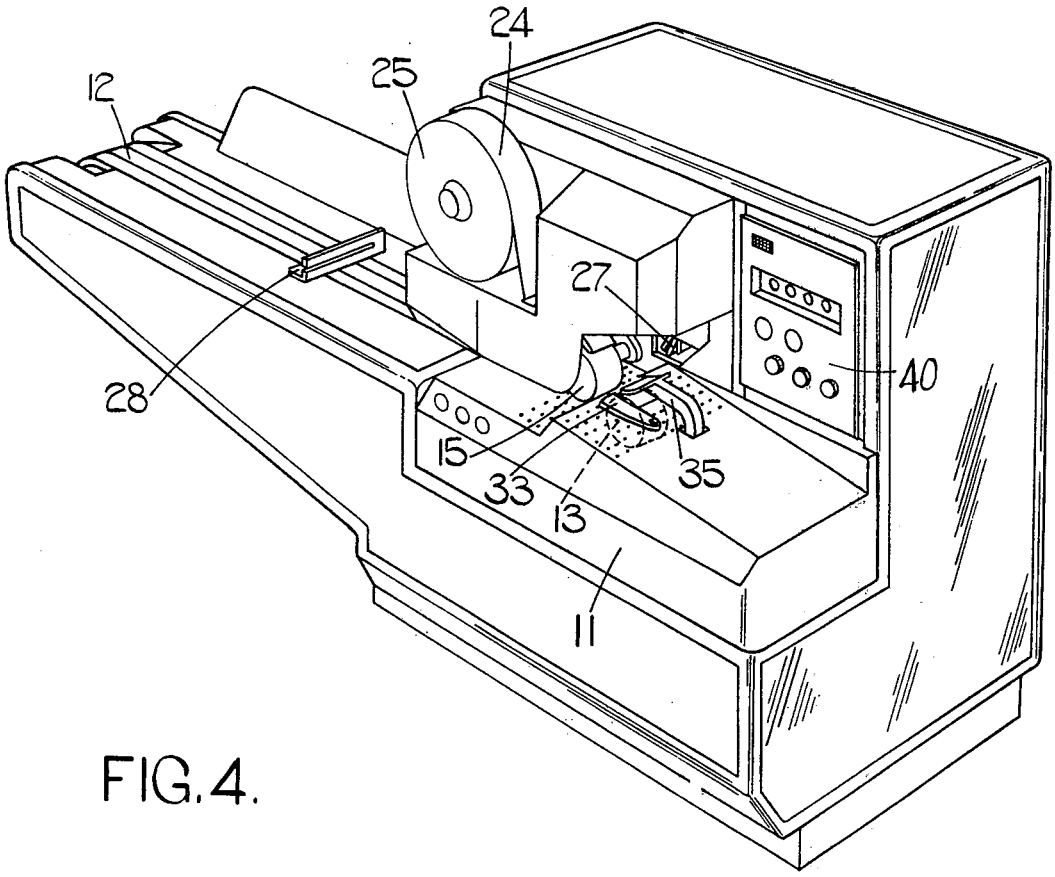
Figure 5:
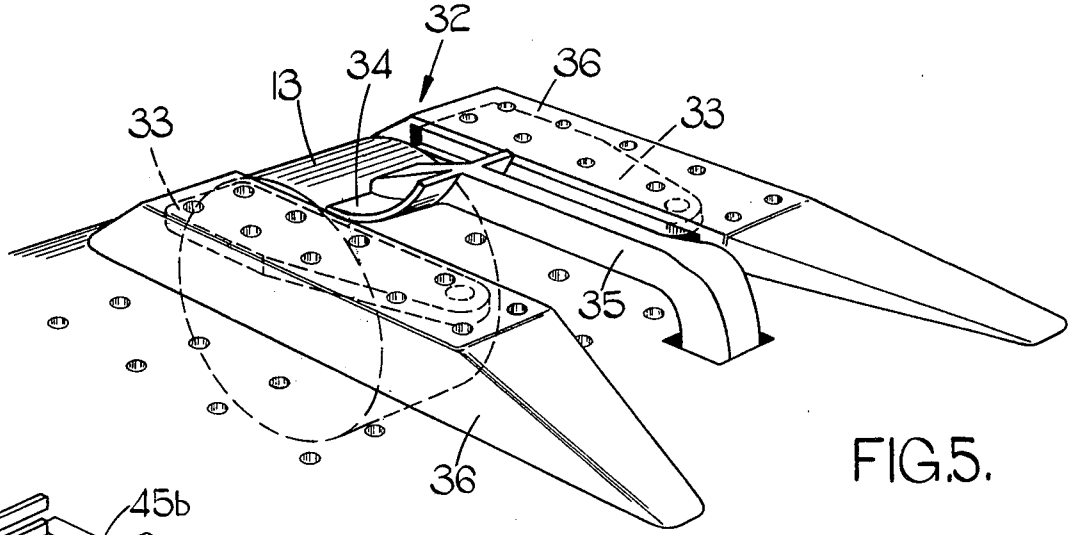
Figure 7:
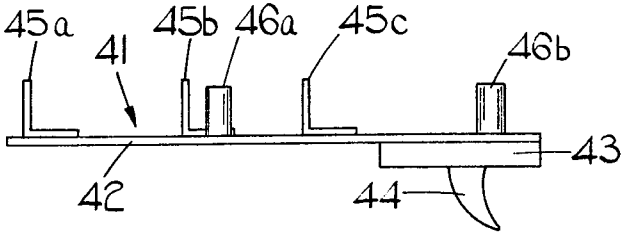
Figure 6:
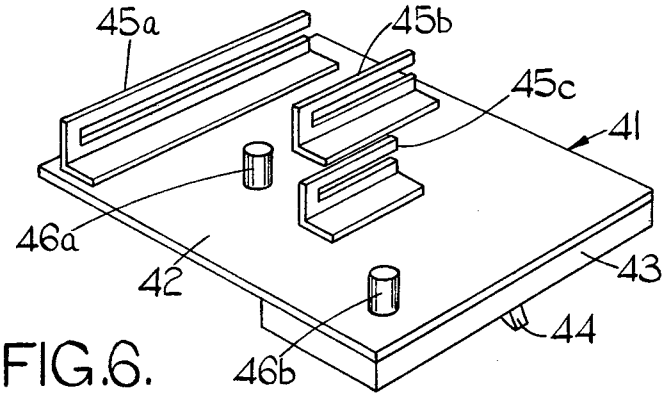

One example of the invention is illustrated in the accompanying drawings wherein;

FIG. 1 is a diagrammatic representation of apparatus for use in the manufacture of a wiring harness;

FIG. 2 is a fragmentary view to an enlarged scale of part of the apparatus shown in FIG. 1, with a minor modification, FIG. 3 is a sectional view of part of the apparatus shown in FIG. 2, FIG. 4 is a perspective view of a more practical realisation of the apparatus shown in FIG. 1, FIG. 5 is an enlarged view of part of FIG. 4, FIG. 6 is a perspective view to an enlarged scale of a lead gripper for use in the apparatus shown in the preceding views and, FIG. 7, is a side elevational view of the lead gripper shown in FIG. 6.

Referring to the drawings, the apparatus includes a supporting bed 11 which is extended at one end 11a to carry a short conveyor 12. The conveyor 12 can take a number of forms and may for example be the belt type conveyor shown in FIG. 1, or the roller chain type conveyor shown in FIG. 2. Adjacent one end of the conveyor 12 the bed 11 supports a drive roller 13 the cylindrical surface of which is resilient, the roller being a steel roller having an outer sleeve of silicon rubber. The drive roller lies almost wholly within the bed 11 with the surface thereof exposed through an aperture in the bed 11. The roller 13 is rotated by means of an electric motor which also drives the conveyor 12, the surface speed of the roller 13 being equal to the surface speed of the conveyor 12.

Upstanding from the bed 11 adjacent the roller 13 is a support structure 14 carrying a second roller 15. The second roller 15 is similar to the roller 13 in that its outer cylindrical surface is defined by a silicon rubber sleeve. The roller 15 is not directly driven, but is supported for rotation on a shaft 16 FIG. 3, carried in first and second bearings 17, 18 respectively. The bearing 18 at the end of the shaft 16 remote from the roller 15 is pivotally mounted on the support structure 14 for pivoting movement about an axis parallel to the plane of the bed 11. Thus the roller 15 can be moved towards and away from the roller 13, the shaft 16 pivoting about the axis of the pivotal mounting of the bearing 18. Additionally, the bearing 18 is adjustable in position relative to the bed 14 for initial setting purposes.

The bearing 17 is carried at one end of the piston rod 21 of a pneumatic cylinder 19. There is a pivotal connection at 22 between the bearing 17 and the piston rod 21 so that the roller 15 can be moved towards and away from the roller 13 without movement of the body of the cylinder 19. The cylinder 19 is a double acting cylinder, and withdrawal of the piston rod 21 lifts the roller 15 away from the roller 13. Reversal of the air pressure supply to the cylinder 19 causes extension of the piston rod 21 to press the roller 15 against the roller 13. The pressure applied by the roller 15 to the roller 13, and of course to any parts interposed between the rollers, is determined by the pressure applied to the cylinder 19. The support structure 14 carries a tape dispenser 23 for dispensing thermoplastic tape 24. The tape dispenser 23 includes a tape reel 25 mounted for rotation freely about an axis parallel to the axis of the roller 13. Additionally, the dispenser 23 includes a tape drive unit 26 which when operated, draws tape from the reel 25, and feeds it to the pinch of the rollers 13, 15. The tape drive is only operated at the finish of a harness manufacture to feed tape into the rollers 13, 15 in readiness for the manufacture of the next harness.

A hot air blower 27 is carried by the support structure 14 and is movable relative thereto linearly in a direction parallel to the axis of rotation of the roller 13. The hot air blower 27 has a rest position wherein when operative it discharges hot air into an extraction grill 30 in the bed 11 so that the flow of air from the blower 27 does not heat the region of the rollers 13, 15. The grill 30 is part of an air extraction system operative in the region of the rollers 13, 15 which in extracting hot air from the region of the rollers 13, 15 causes an influx of cooling ambient air. The hot air blower has an operative position spaced from its rest position wherein the hot air discharged from the blower 27 is discharged onto the pinch of the rollers 13, 15 and a double acting pneumatic cylinder (not shown) is coupled to the hot air blower 27 and serves to move the hot air blower 27 between its rest and operative positions along the guides of the support structure 14.

The conveyor 12 whether it be the roller chain conveyor shown in FIG. 2, or the belt type conveyor shown in FIG. 1 is arranged to receive at predetermined points along its length, lead grippers 28. Each lead gripper 28 consists of a slotted plate the slot of the plate being of width slightly less than the diameter of the leads to be gripped so that the leads can be inserted into the slot and thereafter will be lightly gripped by the gripper. Each gripper can be engaged with the conveyor at any one of a number of equally spaced locations along the length of the conveyor, and the grippers are readily detachable from the conveyor. For example, where the conveyor is a roller chain conveyor then a gripper may be engaged with the top run of the conveyor adjacent its start, and will be disengaged from the conveyor at the end of the top run by the conveyor passing over the supporting sprocket at the end of the top run. The teeth of the supporting sprocket detach the gripper from the roller chain as the chain passes over the sprocket. A similar arrangement can be provided for the belt type conveyor in that a roller at the end of the top run of the conveyor can disengage the lead grippers as the belt passes over the roller.

When the apparatus is at rest, but is ready for operation, that is to say the hot air blower 27 is at its desired working temperature, then the hot air blower will be in its rest position discharging air into the extraction grill 30 the roller 13 and conveyor 12 will be stationary, and the roller 15 will be spaced from the roller 13. The harness which the apparatus is intended to produce is of the kind comprising a plurality of elongate leads each having a conductive core within a thermoplastic sheath, and an elongate thermoplastic backing strip to which the sheaths of the leads are fused, the backing strip serving to retain the leads in position relative to one another. Leads may enter, or leave the harness at points along its length. In order to produce such a harness utilising the apparatus, an operator selects the require cut and terminated leads from a storage rack and engages the ends of those leads which are to extend to one end of the harness with a cable gripper, the leads having their end portions inserted into the slot of the cable gripper. The cable gripper 28 is then engaged with the top run of the conveyor 12 at a point along the top run spaced from the roller 13 by a distance equal to the desired free length of the leads at the end of the harness, that is to say a distance equal to the length by which it is desired that the leads shall project freely beyond the end of the thermoplastic backing strip of the harness. The leads are positioned side-by-side, and generally parallel, and are led back from the cable gripper 28 between the rollers 15,13 it being recalled that the roller 15 is at this stage spaced from the roller 13 to permit insertion of the leads. The leads are then passed through a guide assembly 32 (FIGS. 4 and 5) positioned adjacent the roller 13 the assembly 32 serving to arrange and retain the leads parallel and closely adjacent one another as they pass between the rollers 13, 15. The roller 15 is then moved towards the roller 13 so that the leads passing over the roller 13 are gripped between the rollers 13, 15 and the roller 15 applies a predetermined pressure thereto. The free end of the tape 24 is fed to the pinch of the rollers 13, 15 and engages the surface of the leads 31 at the pinch of the rollers. Thereafter, the drive to the roller 13, and the conveyor 12 is completed the drive to the tape dispenser 26 is stopped and simultaneously the hot air blower 27 is moved to its operative position wherein it discharges hot air into the pinch of the rollers 13, 15 and so heats the mutually presented surfaces of the tape 24 and the leads 31. The roller 13 drives the leads and the tape 24 through the apparatus drawing the tape from its supply reel and the leads through the assembly 32, the heated surfaces of the tape 24 and leads 31 being pressed together as they pass through the pinch of the rollers 13, 15. The heating of the surfaces of the tape 24 and the sheaths of the leads 31 by the hot air blower 27 is such that as the surfaces are pressed together by the rollers they fuse together so that upon leaving the rollers 13, 15 the leads are firmly secured to the backing strip defined by the tape 24 having their sheaths fused to the tape 24. The conveyor 12 does not draw the leads through the apparatus, but merely serves to carry the completed harness, as it leaves the pinch of the rollers 13, 15 away from the rollers 13, 15. The speed at which the leads and tape are driven between the rollers by the drive roller 13 is so chosen in relation to the output temperature of the hot air blower 27 that a good bond is produced between the sheaths of the leads and the tape without burning of the sheaths of the leads or the tape.

Production of the harness progresses in this manner until a point is reached at which it is necessary either to insert a further lead, or permit one of the existing leads to branch outwardly from the harness. When such a point is reached the drive to the roller 13, and the conveyor 12 is stopped, and simultaneously the hot air blower 27 is returned to its rest position so that hot air is not discharged onto the stationary tape and leads at the pinch of the rollers. If it is required to permit one of the existing leads 31 to branch out of the harness then the appropriate lead is released from the guide assembly 32 and is led away from the apparatus at right angles to the length of the bed. If it is desired to insert a further lead with only a short length of lead free of the backing tape then the further lead also cut to length, and appropriately terminated is positioned in the pinch of the rollers 13, 15 with its free end length at right angles to the harness. However, if a long free length is required to the end of the lead, is engaged with a further lead gripper which in turn is engaged with the conveyor 12 at a point spaced along the length of the conveyor 12 from the roller 13 by a distance equal to the desired free length of the additional lead and the roller is lifted away from the roller 13 to pass the lead therebetween. In either case the additional lead is then engaged in the lead guide assembly 32. The apparatus is then re-started, closing the roller 15 onto the roller 13, if it was necessary to move the roller 15 to insert a lead requiring a long free length and re-establishing the drive to the conveyor 12 and the roller 13. As the drive is re-established the hot air blower 27 is returned to its operative position and production of the harness continues until a further point along the length of the harness where it is necessary to insert, or branch out a lead is reached.

The desired harness length is of course accurately known. At a predetermined point in the production of the harness shortly before the full length of harness has been produced, a guillotine 30 in the tape dispenser 23 is operated to sever the tape 24. The apparatus continues to operate to produce the full length of harness, and as the full length of harness is completed then drive to the conveyor 12 and roller 13 is stopped and the hot air blower 27 is returned immediately to its rest position. The roller 15 is then moved away from the roller 13 thus releasing the harness and the completed harness can then be removed from the apparatus. It will of course be understood that there will be a free length of the leads at the trailing end of the harness to which tape is not fused. The harness is of course released, and the apparatus stopped prior to this free length passing through the rollers so that the free lengths of the leads are not subject to heating.

The harness will of course be considerably longer than the length of the conveyor 12, but this does not matter since the conveyor 12 is not drawing the harness through the apparatus, but merely serving to carry completed harness away from the rollers. On some occasions when a new lead is inserted it will have an appropriate lead gripper and even though the initial lead gripper at the start end of the harness may have moved sufficiently far to have become disengaged from the conveyor one or more other lead grippers associated with leads inserted along the length of the harness will still be engaged with the conveyor and thus the harness will always be carried by the conveyor away from the rollers 13, 15. Even in the event that there are no intermediate lead grippers then the harness itself will by lying in contact with the conveyor and since it is being driven through the apparatus by the rollers will be carried by the conveyor away from the rollers.

The lead guide assembly 32 which is omitted from FIG. 1 but shown clearly in FIGS. 4 and 5, is important in that it constrains the leads to a close, flat, parallel configuration as they pass between the rollers 13, 15. The assembly includes a pair of laterally movable fingers 33 pivotted for movement about generally vertical axes and swingable about their axes towards and away from one another so as to reduce and increase, the switch of the gap between them. The fingers 33 engage the outer edges of the outermost leads, and apply a lateral constraining force to the leads to hold the leads in contact with one another. In addition, there is a vertically movable shoe 34 which in use urges the leads downwardly against the surface of the apparatus immediately adjacent the roller 13. Thus the fingers 33 and the shoe 34 together arrange, and constrain the leads to a flat parallel configuration wherein the leads are in contact with one another as they pass between the rollers 13, 15. The shoe 34 is carried by a pivotted arm 35 around which the leads pass. The arm 35 is pivotted for movement about a generally horizontal axis, and below the pivot axis the arm includes an elongate cam extending generally parallel to the portion of the arm between the pivot and the shoe, the elongate cam being engageable by a linearly movable cam follower. A spring acting against the cam urges the cam and the arm to pivot about the horizontal axis in a direction to engage the shoe 34 with the leads, but movement of the cam follower in one linear direction moves the cam, and therefore the arm and the shoe against the action of the spring to lift the shoe away from the leads to permit loading of the leads beneath the shoe. Movement of the cam follower in the opposite direction permits the spring to return the shoe into engagement with the leads.

The cam follower is movable in both directions by an air cylinder and the cam follower is formed on its opposite lateral edges with a rack. Each rack is engaged by a horizontally disposed pinion, each pinion being coupled to a respective one of the fingers 33. Movement of the cam follower in a direction to raise the shoe 34 causes movement of the fingers 33 about their pivot axes in a direction to move the fingers 33 away from one another. Thus as the shoe 34 is raised to permit introduction of leads the fingers 33 are similarly moved apart. When the cam follower is moved in the opposite direction to permit the shoe 34 to engage the leads, the movement of the cam follower moves the fingers 33 through their rack and pinion mechanisms, towards one another to urge the leads into contact with one another laterally.

The fingers 33, in their retracted positions, are covered by shaped cover plates 36 from which the fingers protrude laterally when they are moved to their operative positions. The casing of the apparatus around the assembly 32, and the covers 36 conveniently are pierced and define an outer wall of a chamber which is evacuated by the air extraction system of the apparatus. Thus air is drawn inwardly through the piercing of the casing and the covers so causing an influx of cooling ambient air to the region of the assembly 32 and rollers 13, 15. In addition, the arm 35 carrying the shoe 34 can be formed internally with an air passage which open adjacent the shoe 34 and by means of which cooling air can be pumped to the shoe 34.

It will be understood that if desired control of the apparatus can be manual. However, in the interests of accuracy and efficiency it is more preferably to have automatic control of the apparatus. Thus the apparatus includes a control mechanism 40 controlling operation of the various drives, and movement of the hot air blower 27 between its rest and operative positions. In one convenient form, the control mechanism includes a counter which counts electrical pulses generated in the drive mechanism of the conveyor 12 and rollers. A pulse is generated for each unit measure for example each inch of movement of the conveyor 12 and rollers and since the desired overall length of the harness is accurately known, and the points at which leads are to be inserted, and branched out of the harness are accurately known then the control mechanism can be set to stop operation of the apparatus after receiving predetermined numbers of pulses. In addition the apparatus includes a manual control facility and in practice some signals controlling the apparatus will be derived from manual controls, for example the start signal and the signal causing movement of the roller 15 away from the roller 13. Considering a simple example of a harness which is 120 inches in overall length, and which has 10 inches of free lead at either end, then there will be 100 inches of the harness requiring backing strip, thus the tape must be fused to the sheaths of the leads for this 100 inch length. Additionally, the harness requires a lead to be inserted 30 inches from its leading end with a 10 inch free length and at a point 60 inches from its leading end requires an existing lead to be branched out laterally of the main run of the harness. In order to produce such a harness those leads which are to extend to the leading end of the harness are engaged in a lead gripper, and the lead gripper is engaged with the conveyor 12 such that the lead gripper is spaced by 10 inches from the roller 13. The leads are passed between the rollers 13, 15 and through the assembly 32 the roller 15 being lifted away from the roller 13 and the assembly 32 having the fingers and the shoe in their lead released positions. The counter of the apparatus control mechanism is at zero, the free end of the tape is adjacent the rollers and the operator supplies the control mechanism by means of simple push-buttons first with a signal causing roller 15 to trap the leads against roller 13 and causing the fingers 33 and shoe 34 to engage the leads and then with a start signal. Upon receipt of the start signal the control mechanism supplies simultaneous signals to the drive arrangement of the conveyor 12 and roller 13, to start the conveyor 12 and rollers in motion, and to the air cylinder controlling the position of the hot air blower 27 to move the blower 27 from its rest position to its operative position. The apparatus then continues to produce the harness until the counter of the control mechanism reaches a count of 20, at which point of course 20 inches of the harness will have had backing strip bonded thereto. At this point there will be 30 inches of harness, 20 inches having backing strip bonded thereto, and 10 inches of free length of leads at the leading end of the harness. Thus the 30 inch point at which a lead input is required has been reached and the count of 20 in the counter of the control mechanism will result in simultaneous signals to the drive of the conveyor 12 and the rollers to stop the drive and to the air cylinder of the hot air blower 27 to return the blower 27 to its rest position. Since the lead to be inserted requires a long free length (10 inches) the lead has its leading end engaged with a further lead gripper which is then engaged with the conveyor 12 at a point spaced from the roller 13 by 10 inches. A signal is then introduced by means of a manual push-button to withdraw the roller 15 and to release the guide assembly fingers 33 and shoe 34. The additional lead is then passed back between the rollers 15, 13 and through the lead guide assembly 32. The operator once again presses the button causing the return of the roller 15 and operation of the assembly 32 and then presses the start button, and upon receipt of the start signal the control mechanism supplies simultaneous signals to the drive of the conveyor 12, and the roller 13 to re-establish the drive, and to the air cylinder of the hot air blower 27 to return the blower 27 to its operative position. Production of the harness then progresses until the count in the counter reaches 50, signifying the point along the length of the harness at which an existing lead must be branched laterally out of the harness. Thus upon reaching a count of 50 the operation of the apparatus ceases, the drive to the conveyor 12, and rollers being stopped, and the hot air blower 27 being returned to its rest position. The operator then extracts the lead in question from the lead guide assembly 32 and bends the lead at its point of connection with the tape, so as to extend at right angles to the tape. Thereafter the operator presses the start button again to re-establish operation of the apparatus, and the apparatus continues to fuse the tape 24 to the sheaths of the leads until the counter reaches a count of 95 whereupon the control mechanism supplies a signal to the guillotine of the tape dispenser to sever the tape. However, at this point there is no signal to the remaining parts of the apparatus and so the apparatus continues to operate, the tape which is being fused to the leads being that length of tape between the rollers and the guillotine. This distance is conveniently 5 inches in the present example, and thus as the cut end of the tape passes between the rollers the count in the counter of the control mechanism will reach 100. 100 inches is of course the length of the harness requiring backing strip and thus upon reaching the count of 100 the control mechanism will supply simultaneous signals to the drive of the conveyor 12 and rollers to stop the drive and to the hot air blower 27 to return the hot air blower 27 from its operative position to its rest position. Additionally, since the 100 inch count represents the completion of a harness a signal is also supplied to the counter to re-set the counter to zero in readiness for the production of a further harness. The operator pushes the button to cause withdrawal of the roller 15 and release of the assembly 32 and then disengages the free ends of the leads at the trailing end of the harness from the lead guide assembly 32, and removes the completed harness from the apparatus. Thereafter it is only necessary for him to remove the lead grippers from the harness in readiness for use in the production of a further harness.

It is desirable that the free end of the tape is positioned adjacent the rollers in readiness for a further cycle of operation. This can be achieved as a separate manual operation but preferably is achieved under the control of the control mechanism. Thus in the example described above when the counter reaches 95 the signal controlling the guillotine is also stored by a relay of the control mechanism. When the operator, at the 100 count operates the push button to release the assembly 32 and withdraw the roller 15 the signal for this operation is also supplied to said relay and upon receipt of the second signal the relay causes the drive to the tape dispenser is established. The drive to the dispenser is maintained for a predetermined period of time by a timer in the control mechanism the time period being such that 5 inches of tape is dispensed, it being recalled that 5 inches in the length of the tape path between the guillotine and the roller 13.

It will be appreciated that the control mechanism including the counter, which in effect programmes the machine will always ensure that the blower 27 is in its rest position when the roller 13 is stationary so that hot air is not directed onto the stationary rollers, or onto stationary leads and tape at the pinch of the rollers. Moreover, the apparatus can be used to produce a wide variety of different harness requirements merely by appropriate setting of the control mechanism and counter.

It is not essential that the tape dispenser includes a driven arrangement for positively driving tape, since if desired the tape could be threaded manually into the pinch of the rollers, and thereafter drawn from the reel 25 by the action of the rollers. Moreover, the hot air blower 27 could be replaced by other forms of heater, for example if desired an infra-red radiant heater could be utilized.

In the construction described above both rollers 13, 15 are resilient by virtue of their external sleeves. However in some circumstances only one of the rollers need be resilient preferably the roller 13. Moreover where the apparatus is intended for harnesses having leads all of the same diameter it is not essential for either roller to be resilient and in the case of apparatus for producing harnesses with leads of different diameter but always similarly positioned one of the non-resilient rollers can be grooved to accommodate the larger diameter leads, the smaller diameter leads being accommodated by setting the working gap between the rollers to an amount slightly less than the diameter of the leads plus the backing strip thickness.

In order to assist the operator in determining the position at which a lead gripper is to be coupled to the conveyor to give the desired free lead length, the bed 11*a* can carry a rule or predetermined markings. Alternatively there may be a row of lights spaced along the bed 11*a* the appropriate light being energised at the appropriate time under the control of the control mechanism to indicate the correct position at which to engage the gripper with the conveyor.

In the foregoing description, the lead grippers are each in the form of simple slotted plate. However, as shown in FIGS. 6 and 7 a composite lead gripper can be provided which is capable of trapping the ends of a plurality of leads at different longitudinal spacings relative to one another. The gripper 41 shown in FIGS. 6 and 7 comprises a metal plate 42 having a moulded synthetic resin anchor piece 43 secured to the lower face thereof at one end. The anchor piece 43 is of the form utilised with the grippers described above, and comprises a tapering curved projection 44 which is introduced between adjacent rollers of the roller chain conveyor. While the lead gripper lies on the top run of the conveyor the projection 44 ensures that the gripper is carried by the chain along the length of the top run. However, as the roller chain of the conveyor passes over the end sprocket the sprocket teeth entering between adjacent rollers of the chain from below displaces the projection 44 upwardly so that the gripper becomes disengaged from the chain. On the upper surface of the plate 42 are a plurality of slotted plates 45 which function in exactly the same manner as the slotted plates of the lead grippers described above. In addition to the slotted plates 45 there are a number of cylindrical posts 46. The slotted plates 45 and posts 46 are spaced both longitudinally of the plate and laterally of the plate, and the posts 46 are intended to act as anchors for leads having eyelet type terminals. The eyelet type terminals being engaged over the posts. The lateral dimensions of the slotted plates 45, and the relative longitudinal and lateral positionings of the plates and posts are chosen to suit the desired lead and terminal configuration at the leading end of a particular harness and in the arrangement shown therefore all of the leads will extend through the gripper 45*a* at the end of the plate 42 remote from the anchor piece 43, and those leads having the shortest free length will have their terminals closely adjacent the plate 45*a*. Some of the leads having a longer free length will be engaged with the next plate, 45*b* and those with longer free lengths will be engaged with the plate 45*c*. One or more of the leads having eyelet terminals and requiring a medium free length will be engaged with the post 46*a* and those requiring the longest free length and having eyelet terminals will be engaged with the post 46*b* which is towards the end of the plate 42 adjacent the anchor piece 43.

Although with all of the lead gripper arrangements described above it is necessary to detach the lead gripper manually from the harness at the end of the manufacture of the harness, it is envisaged that automatic release of a gripper assembly from the harness could be achieved.

I claim:

1. Apparatus for use in the manufacture of a wiring harness of the kind including a plurality of conductive leads and a thermoplastic tape, each lead including a thermoplastic sheath containing the conductive core of the lead, the thermoplastic sheaths of the leads being fused to the thermoplastic tape to hold the leads in desired relative positions, the apparatus comprising first and second rollers between which the leads and the thermoplastic tape pass in use, whereby the rollers press the tape against the leads, means driving at least one of the rollers so that the leads and tape are driven between the rollers by rotation of the rollers, movable heater means for heating the mutually presented surfaces of the tape and the sheaths of the leads prior to their passage between the rollers whereby the pressure applied by the rollers causes the heated surfaces of the tape and sheaths of the leads to fuse together, means for moving said heater means between an operative position and a rest position wherein said heater means is spaced from said rollers, and a setable control mechanism operable at a predetermined point in the production of the harness, after a predetermined length of harness has been produced, to stop the roller drive and to return said heater means to its rest position, whereby a lead of the harness can be branched out of the harness or an additional lead can be introduced into the harness at said predetermined point in the harness.

2. Apparatus as claimed in claim 1 wherein one of said first and second rollers is resilient.

3. Apparatus as claimed in claim 1 wherein one of the first and second rollers is movable relatively towards and away from the other roller to permit insertion and removal of leads.

4. Apparatus as claimed in claim 1 wherein there is provided a conveyor mechanism for conveying the harness as it leaves the rollers, away from the rollers, the conveyor being driven at the speed at which the tape and leads passes between the rollers.

5. Apparatus as claimed in claim 4, wherein the drive to the conveyor is directly linked to the drive to the roller(s) so that the roller(s) and conveyor always operate in unison.

6. Apparatus as claimed in claim 1 including a tape feed assembly for feeding tape into the rollers the tape feed assembly including a guillotine for cutting the tape.

7. Apparatus as claimed in claim 6 wherein, the control of the guillotine is effected by the control mechanism, the guillotine being operated to sever the tape when a predetermined length of harness has been produced.

8. Apparatus as claimed in claim 1 including air extraction means whereby hot air is extracted from the region of the heater, and the rollers while the heater is operative, the extraction of hot air causing an influx of cool air to said region.

9. Apparatus as claimed in claim 8 wherein said hot air extraction extends to the region occupied by the heater in its rest position.

10. Apparatus as claimed in claim 1 wherein said control mechanism controlling the drive to the rollers, directly controls the means for moving the heater so as to operate the two in synchronism, said mechanism being arranged upon receipt of a manually controlled re-start signal, to cause the drive to the rollers to be re-established simultaneously with causing return of the heater means to its operative position.

* * * * *